US005848752A

United States Patent [19]

Kolacz et al.

[11] Patent Number: 5,848,752

[45] Date of Patent: Dec. 15, 1998

[54] FOAM AERATION NOZZLE

[75] Inventors: David J. Kolacz, Plymouth; Robert W. Steingass, Valparaiso, both of Ind.

[73] Assignee: Task Force Tips, Inc., Valparaiso, Ind.

[21] Appl. No.: 960,087

[22] Filed: Oct. 24, 1997

Related U.S. Application Data

[63] Continuation of Ser. No. 525,913, Sep. 8, 1995, abandoned.

[51] Int. Cl.[6] ..... E03C 1/08

[52] U.S. Cl. ..... 239/428.5; 239/439; 239/507; 169/14; 169/89

[58] Field of Search ..... 239/398, 407, 239/318, 427, 432, 434, 428.5, 461–2, 439, 507, 456–8, 499, 514; 169/14, 15, 89

[56] References Cited

U.S. PATENT DOCUMENTS

| | | | |
|---|---|---|---|
| 2,774,583 | 12/1956 | Haftke | 261/76 |
| 2,928,611 | 3/1960 | Lauderback et al. | 239/428.5 |
| 2,936,960 | 5/1960 | Thompson | 239/452 |
| 3,244,376 | 4/1966 | Thompson | 239/458 |
| 3,348,777 | 10/1967 | Hjulian | 239/424.5 |
| 3,424,250 | 1/1969 | Thomae | 169/15 |
| 3,539,112 | 11/1970 | Thompson | 239/452 |
| 3,540,657 | 11/1970 | Thompson | 239/458 |
| 3,547,200 | 12/1970 | Hout | 169/15 |
| 3,561,536 | 2/1971 | Henshaw | 169/15 |
| 3,682,388 | 8/1972 | Ferguson | 239/222.17 |
| 3,724,762 | 4/1973 | Freshour et al. | 239/427.3 |
| 3,836,076 | 9/1974 | Conrad et al. | 239/8 |
| 3,853,784 | 12/1974 | Rogers | 252/359 E |
| 3,918,647 | 11/1975 | Lamz et al. | 239/428.5 |
| 3,946,947 | 3/1976 | Schneider | 239/401 |
| 3,961,754 | 6/1976 | Kuhns et al. | 239/289 |
| 4,013,228 | 3/1977 | Schneider | 239/401 |
| 4,044,954 | 8/1977 | Campbell | 239/458 |

(List continued on next page.)

FOREIGN PATENT DOCUMENTS

| | | |
|---|---|---|
| 386 746 | 3/1988 | Australia . |
| 102020 | 11/1977 | Canada . |
| 2 032 274 | 5/1980 | United Kingdom . |
| 2 203 065 | 10/1988 | United Kingdom . |
| 2 256 029 | 11/1992 | United Kingdom . |
| 2 289 229 | 11/1995 | United Kingdom . |

OTHER PUBLICATIONS

Brochure of Angus Fire Armour—PAM 4/84–5M–Foam Fire Fighting Equipment (date unknown).

Brochure of Scott Plastics Ltd. on Fire Fighter Product Line (date unknown).

Brochure of Delta Fire Ltd. on Foam Equipment Technology (date unknown).

Brochure of Groupe Leader S.A. Titled Aujourd Hui Les Techniques Du Futur (date unknown) (in French).

Article titled Calculs Sur Les Lances a Mousse, by Jean–Francois Bechker (date unknown) (in French).

(List continued on next page.)

*Primary Examiner*—Andres Kashnikow
*Assistant Examiner*—Lisa Ann Douglas
*Attorney, Agent, or Firm*—Marshall, O'Toole, Gerstein, Murray & Borun

[57] ABSTRACT

This disclosure relates to an improved foam aeration nozzle comprising a peripheral jet nozzle, a spray collector which receives the jet and produces a fully filled spray, and an aeration device which agitates and aerates the spray and produces the foam. In use, the peripheral jet nozzle produces an annular cone-shaped spray or sheet of water. A collector is attached to the nozzle, the collector including a tubular wall in the path of the conical spray. The collector further includes an annular obstruction, and the water, as it moves along the wall surface, strikes the obstruction. At least a portion of the water is deflected toward the axis of the nozzle by the obstruction to produce a fully filled spray. An aeration device downstream of the obstruction is located to be impinged by the fully filled spray and to convert the spray to a foam and to discharge the foam on an intended target at a useful distance.

16 Claims, 7 Drawing Sheets

U.S. PATENT DOCUMENTS

| | | | |
|---|---|---|---|
| 4,095,749 | 6/1978 | Campbell | 239/458 |
| 4,176,794 | 12/1979 | Allenbaugh, Jr. | 239/498 |
| 4,219,159 | 8/1980 | Wesner | 239/343 |
| 4,244,426 | 1/1981 | Kerr | 169/51 |
| 4,252,278 | 2/1981 | McMillin | 239/583 |
| 4,289,277 | 9/1981 | Allenbaugh | 239/452 |
| 4,318,443 | 3/1982 | Cummins | 169/15 |
| 4,330,086 | 5/1982 | Nysted | 239/8 |
| 4,497,442 | 2/1985 | Williams | 239/437 |
| 4,503,915 | 3/1985 | Gagliardo et al. | 169/15 |
| 4,589,439 | 5/1986 | Steingass | 239/456 |
| 4,640,461 | 2/1987 | Williams | 239/317 |
| 4,646,973 | 3/1987 | Focaracci | 239/432 |
| 4,653,693 | 3/1987 | Steingass | 239/460 |
| 4,669,665 | 6/1987 | Shay | 239/428.5 |
| 4,730,775 | 3/1988 | Maas | 239/120 |
| 4,830,790 | 5/1989 | Stevenson | 261/18.1 |
| 4,925,106 | 5/1990 | Maas et al. | 239/333 |
| 4,944,460 | 7/1990 | Steingass | 239/428.5 |
| 5,012,979 | 5/1991 | Williams | 239/416.5 |
| 5,054,688 | 10/1991 | Grindley | 239/407 |
| 5,058,809 | 10/1991 | Carroll et al. | 239/428.5 |
| 5,125,579 | 6/1992 | Eggert | 239/439 |
| 5,248,172 | 9/1993 | Wilson | 285/165 |
| 5,323,861 | 6/1994 | Kaidonis et al. | 169/45 |
| 5,330,105 | 7/1994 | Kaylor | 239/400 |
| 5,344,079 | 9/1994 | Tasaki et al. | 239/498 |
| 5,366,160 | 11/1994 | Balderrama | 239/333 |
| 5,381,957 | 1/1995 | Bianco | 239/99 |
| 5,397,060 | 3/1995 | Maas et al. | 239/333 |
| 5,553,784 | 9/1996 | Theurer | 239/432 |
| 5,678,765 | 10/1997 | Dobbs et al. | 239/428.5 |

OTHER PUBLICATIONS

Article titled Appareillage a Main de Mousse Bas Foisonnement; Appareillage a Main; pp. 54 and 55 (date unknown) (in French).

Pp. 18, 19, 20, 21, and 22 of publication titled *Elkhart Fire Fighting Equipment,* Catalot–T—Date unknown but prior to Sep. 8, 1995.

Pp. 38, 39, 40, and 41 of publication titlted *Akron Catalog Number 106*—Copyright 1987.

Fig. 1
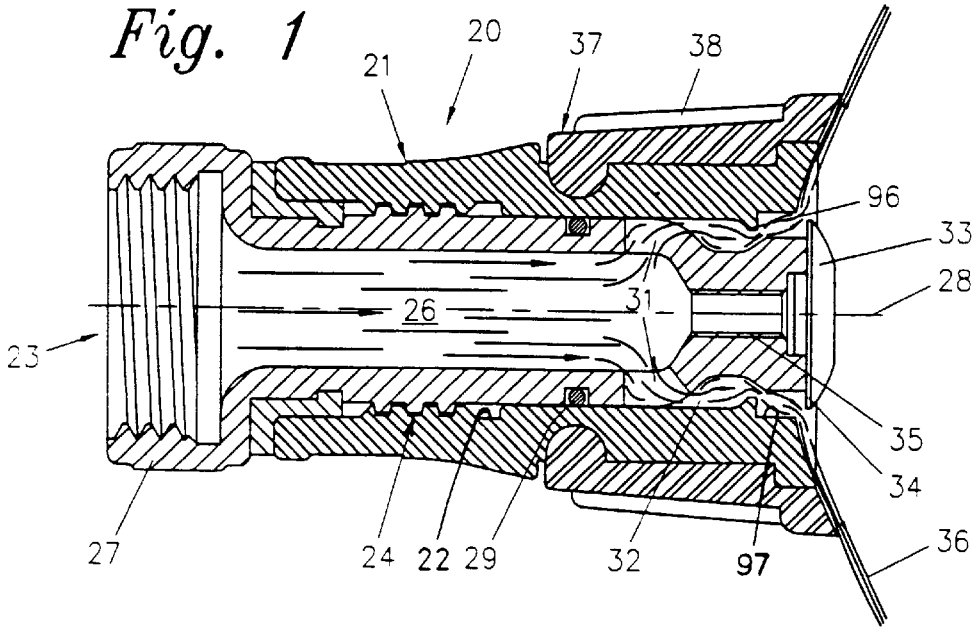
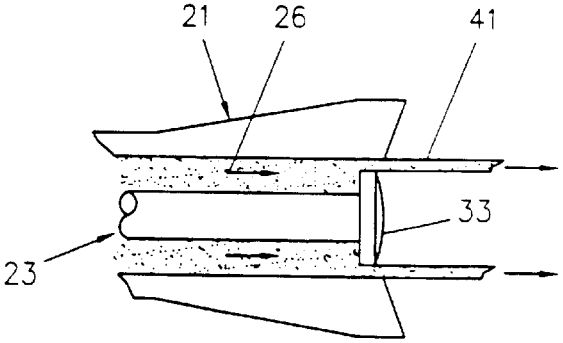
Fig. 2A
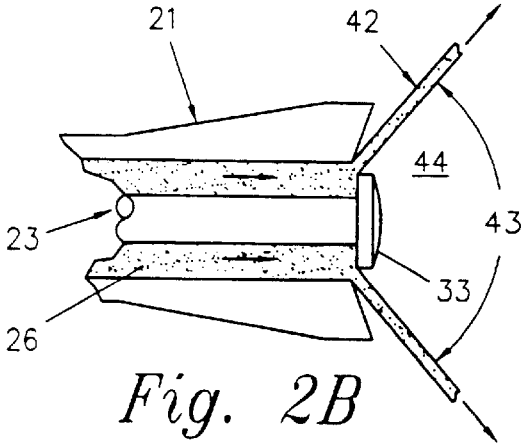
Fig. 2B

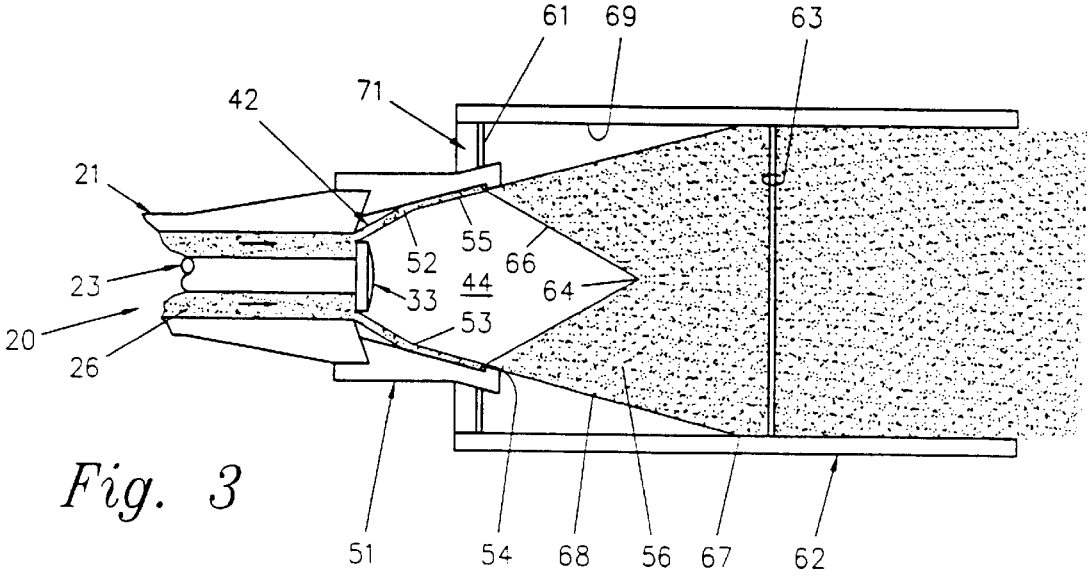
Fig. 3
Fig. 4
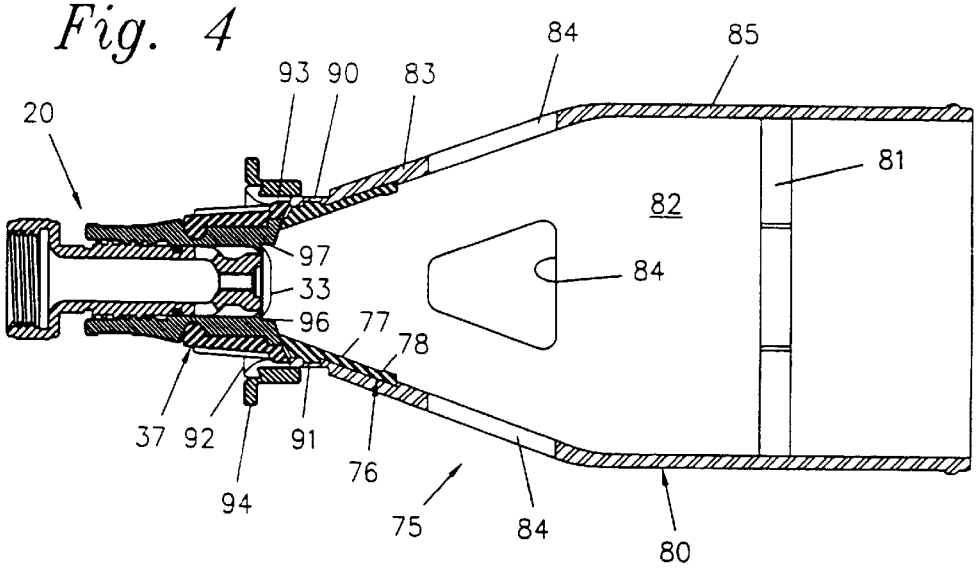

FOAM AERATION NOZZLE

This is a continuation of U.S. application Ser. No. 08/525,913, filed Sep. 8, 1995, now abandoned.

FIELD AND BACKGROUND OF THE INVENTION

This invention relates generally to fire fighting nozzles, and, more particularly, it relates to such a nozzle having a foam aeration capability.

Fire fighting nozzles are available in a variety of styles, one of which is known as a peripheral jet nozzle. The R. W. Steingass U.S. Pat. No. 4,944,460 describes the construction and operation of such a nozzle. Briefly, the fluid exits the nozzle from an annular passage formed by a center disk (baffle) mounted inside the bore of a cylinder (shaper). In another type of peripheral jet nozzle, an annular sheet of fluid is formed by fluid exiting radially from the baffle and is directed forward by impacting against the bore of a shaper. In both types mentioned above, the annular sheet of fluid results in a cone-shaped hollow spray of fluid, and the axial position of the shaper determines the angle of the hollow cone of fluid exiting the nozzle. This spray cone angle is typically fully adjustable between a narrow straight stream and a wide fog pattern, by moving the shaper while the fluid is flowing. The ability to adjust the cone angle is beneficial to meet a situation's needs of fire suppression and nozzle operator protection.

Instead of a fluid, such as plain water, special foam solutions can be used for fire fighting. Properly aerated, the foam solutions can produce a blanket of foam bubbles that aid in fire extinguishment and protection by smothering, separating, cooling and suppression of vapors.

Special nozzles dedicated to applying foam are also available. A dedicated foam nozzle has a fixed orifice which limits acceptable performance to one flow rate. However, they are not effective with plain water since they have very poor stream reach and they do not include means to change the device's exit spray pattern.

A peripheral jet nozzle can also be designed for use to apply foam solutions, in which case an aeration device is placed on the exit end of the nozzle. The above-mentioned Steingass U.S. Pat. No. 4,944,460 describes such an arrangement. The aeration device is generally a tube with an obstruction, such as a screen, to agitate and aerate the foam solution passing through it. Air for the foam is usually provided by air vents at the back of the tube. The aeration device can be removed from the nozzle or adjusted to an out-of-the-way position for plain water operations.

The quality of foam produced by a nozzle is dependent on several factors such as:

Foam type and brand

Percentage of foam concentrate in the solution

Hardness of water

Water and air temperature

Another factor influencing the quality of the foam produced by the foam aeration device relates to the design of the nozzle and the characteristics of the spray passing through the agitation/aeration section. A spray with narrow cone angle, fully filled and made up of relatively small fluid droplets generally provides the best quality foam. The usefulness of this type of spray is described in U.S. Pat. No. 3,561,536. As the spray characteristics vary from this ideal, the foam quality is dramatically reduced. This sensitivity presents a problem for peripheral jet nozzles since the spray exiting from them changes in cone angle and the cone can be hollow. The proper cone angle could be achieved by adjusting the shaper, but this requires very fine adjustment and monitoring by the nozzle operator. Furthermore, even if the proper cone angle is achieved the spray could be hollow which would result in poor foam quality. Most existing foam attachments for peripheral jet nozzles are adapted to make use of only straight stream or conical sprays less than about 61 degrees. Thus only limited expansion ratios are possible, and unwanted spray discharges from the air openings if the nozzle is set on wide fog patterns. Existing foam attachments sold by Task Force Tips, Inc. for variable expansion ratios expel air from the widely angled conical sprays of their peripheral jet nozzles when the spray strikes the inside surface of the aeration device and follows along the wall of the device, thus preventing the best foam from being produced.

SUMMARY OF THE INVENTION

The present invention relates to an improved foam aeration nozzle comprising a peripheral jet nozzle, a spray collector which receives the jet and produces a fully filled spray, and an aeration device which agitates and aerates the spray and produces the foam. In use, the peripheral jet nozzle produces an annular cone-shaped spray or sheet of water. A collector is attached to the nozzle, the collector including a tubular wall in the path of the conical spray. The collector further includes an annular obstruction, and the water, as it moves along the wall surface, strikes the obstruction. At least a portion of the water is deflected toward the axis of the nozzle by the obstruction to produce a fully filled spray. An aeration device downstream of the obstruction is located to be impinged by the fully filled spray and to convert the spray to a foam, and to discharge the foam on the intended target, at a useful distance.

BRIEF DESCRIPTION OF THE DRAWINGS

This invention may be better understood from the following detailed description taken in conjunction with the accompanying figures of the drawings, wherein:

FIG. 1 is a view in section illustrating the construction and operation of a peripheral jet nozzle;

FIGS. 2A and 2B are diagrams which further illustrate the operation of a peripheral jet nozzle;

FIG. 3 is a schematic diagram illustrating the construction and operation of a foam aeration nozzle constructed in accordance with the present invention;

FIG. 4 is a sectional view showing in more detail a foam aeration nozzle including a peripheral jet nozzle and an aeration attachment constructed in accordance with the present invention;

DETAILED DESCRIPTION OF THE INVENTION

Figure 5:
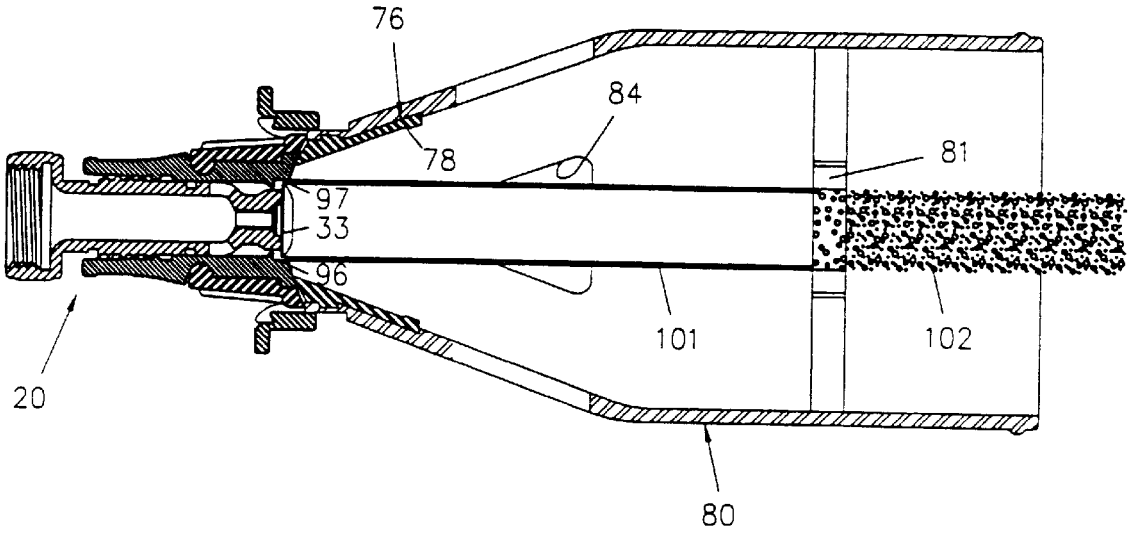
FIGS. 5, 6 and 7 are additional views of the nozzle shown in FIG. 4 but illustrating the different positions of parts of the nozzle and different modes of operation.

While the following description refers to water flowing through the apparatus, it should be understood that other liquids may be used, such as a mixture of water and a foaming compound. Consequently, while the term water is employed, it should be understood that the term as used herein is broad enough to cover other liquids used in fire fighting situations.

With reference to FIG. 1, the peripheral jet nozzle 20 comprises a tubular shaper 21 which forms a cylindrical internal bore 22. Mounted within the bore 22 is a plunger 23 which has a threaded connection, indicated generally by the numeral 24, with the shaper 21. The plunger 23 is also hollow and forms a flow passage 26 for water received from a source (not illustrated) of water under pressure. At the left or rearward end of the plunger 23 is formed a threaded coupling 27 which is connectable to a suitable water source. By rotating the shaper 21 relative to the plunger 23, the shaper 21 is movable (due to the threaded connection 24) along the axis 28 of the nozzle, relative to the plunger 23. An O-ring seal 29 is also provided between the adjoining surfaces of the shaper 21 and the plunger 23.

At the forward (the right-hand end as seen in FIG. 1) of the plunger 23, the flow passage 26 is formed by radial openings 31 through the wall of the plunger 23. The forward end portion of the plunger 23 is spaced radially from the inner bore 22 of the shaper 21 to form an annular flow passage 32. A center disk or baffle 33 is fastened to the forward end of the plunger 23 on the axis of the nozzle by a threaded connection 35, and the radially outer edge portion 34 of the disk 33 extends into the flow passage 32. The annular outer edge 34 of the baffle 33 thus deflects water flowing through the passage 32 axially and radially outwardly in an essentially annular sheet 36.

The peripheral jet nozzle design illustrated in FIG. 1 also includes a ring-shaped part 37 which is secured to the outer periphery of the shaper 21 adjacent the forward end of the nozzle. The hand-hold 37 includes a plurality of ribs 38 which are useful for the operator when turning the shaper 21 relative to the plunger 23.

Further details regarding the construction and operation of a peripheral jet nozzle as shown in FIG. 1 are available from the previously mentioned Steingass U.S. Pat. No. 4,944,460. Briefly, and with reference to FIG. 2A, when the shaper 21 is displaced forwardly (toward the right) relative to the plunger 23, the water flowing through the passage 26 leaves the nozzle in the shape of a generally cylindrical sheet or spray 41 of water. On the other hand, when the shaper 21 is displaced rearwardly relative to the plunger 23 (see FIG. 2B), the water leaves the nozzle in the shape of a hollow cone-shaped sheet of water indicated by the reference numeral 42. The angle 43 of the cone-shaped sheet of water 42, of course, may be varied by adjusting the relative positions of the shaper 21 and the plunger 23. The center area 44 of the cone-shaped sheet of water 42 is essentially hollow.

FIG. 3 illustrates schematically an aeration nozzle constructed in accordance with the invention and includes a peripheral jet nozzle 20 having a construction as shown in FIG. 1. The peripheral jet nozzle includes the outer shaper 21, the plunger 23 including the baffle 33, and the flow passage 26 between the shaper and the plunger, the foregoing parts being illustrated schematically in FIG. 3.

A generally tubular collector 51 is mounted on the forward end of the shaper 21, the collector 51 being formed by a cylindrical wall which forms a tapered inner wall surface 52. The wall surface 52 tapers forwardly and radially outwardly from the forward end of the shaper 21 and the baffle 33, and as illustrated in FIG. 3, the relative positions of the plunger and the shaper cause the sheet 42 of water to strike the internal wall surface 52. In the present illustration, the sheet of water 42 strikes the surface 52 at a point 53 which is substantially midway between the forward end of the shaper 21 and the forward end of the collector 51. Adjacent the forward end of the collector 51 is formed a radially inwardly extending annular obstruction or lip 54 which extends radially inwardly into the stream 55 of water flowing forwardly along the surface 52. Up to the obstruction 54, the sheet 55 flows along the wall 52 and forms a cone-shape sheet which is hollow in the center as indicated by the numeral 44. The obstruction 54, however, deflects a portion of the stream 55 toward the axis 28 of the nozzle, the water forming a spray 56 which is forwardly of the hollow central area 44.

Mounted on the collector 51 by struts 61 is a cylindrical aeration tube 62 which extends forwardly of the collector 51 and is concentric with the axis of the nozzle 20. Extending transversely across the interior of the tube 62 is an aeration and agitation device which, in the present specific embodiment, is formed by a screen 63 which extends radially of the axis of the nozzle 20 and the tube 62 and has its outer periphery secured to the inner wall surface of the aeration tube 62. As shown in FIG. 3, the screen 63 is located (in the axial direction along the length of the tube 62) relative to the collector 51 such that the screen 63 is forwardly of the point 64 where the deflection angle 66 meets the central axis and, thereby, where the spray fills the interior of the spray cone. Further, the screen 63 is located at or just slightly forwardly of the point 67 where the outside wall surface 68 of the spray reaches the inner wall surface 69 of the tube 62. The surface 68 on the outside of the spray is substantially parallel with the stream of water flowing along the inner wall of the collector 51 as shown in FIG. 3.

Thus, the screen 63 is located at the point where the spray cone is completely filled and where the spray reaches the wall 69 just behind the screen 63. Air for aerating the water enters the tube 62 at its rearward end which is radially spaced from the collector 51, the space forming air-flow passages 71 around the struts 61.

The tube 62 may have its location adjusted relative to the collector 51 and the shaper 21 so that the screen 63 is at or just forward of the point 67, and the size and shape of the obstruction 54 plus the angle of the surface 52 may be set to cause the screen 63 to be forward of the point 64. If the screen 63 were substantially to the right relative to the point 67 (which is actually an annular circle), a sizable amount of water would flow from the point 67 along the surface of the tube 62 with the result that aeration at the screen 63 adjacent the inner surface of the tube 62 would not be efficient. At the same time, since the screen 63 is forwardly of the point 64, the cone is substantially filled. As a result, in this construction or relative position shown in FIG. 3, the spray reaching the screen 63 is substantially uniform and produces a most efficient foam product.

FIGS. 4 through 7 illustrate the construction and operation of a peripheral jet nozzle 20 constructed essentially as shown in FIG. 1, combined with an aeration attachment 75 in accordance with the invention, which functions generally similar to the structure shown in FIG. 3. The attachment 75 includes a collector 76 in the shape of a truncated cone having a forwardly and radially outwardly tapered inner surface 77 and an annular radially inwardly extending obstruction or lip 78. The attachment 75 further includes an aeration tube 80 having an aeration device such as a screen 81 extending radially across its interior flow passage 82. From the conical collector 76, the tube 80 angles forwardly and radially outwardly in a tapered portion 83 to a cylindrical aeration section 85, the portion 83 having, in this specific example of the invention, essentially the same angle of taper as the surface 77 of the collector 76. To provide air for the aeration of the water, a plurality of circumferentially spaced apertures or openings 84 are provided in the wall of the tapered portion 83 a short distance forwardly of the collector 76.

Figure 11:
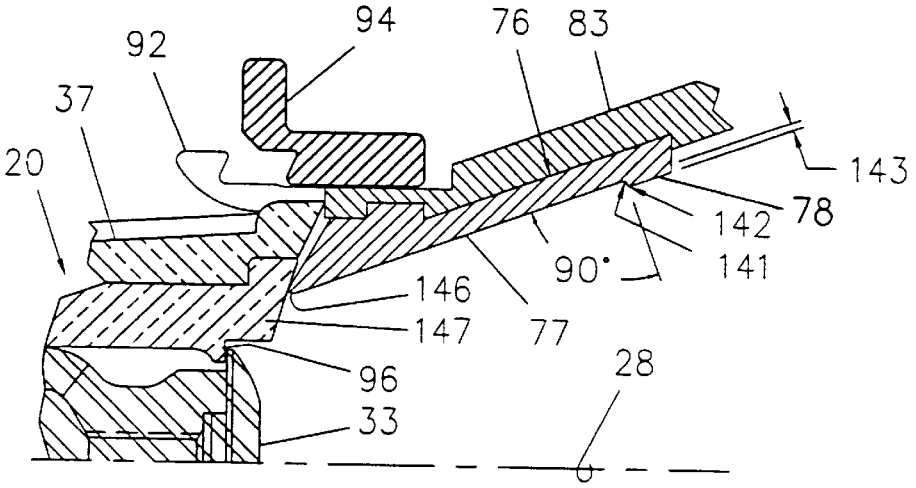
FIG. 11 is an enlarged sectional view showing a portion of the nozzle of FIG. 4.

The collector 76 is attached to the rearward end of the tube 80 by an interlocking annular rib 90 on the collector 76 and a groove 91 formed on the inner side of the tube 80. The rearward end portion 92 of the tube 80 is in the form of a collet which extends over the forward end of the part 37, the forward end of the part 37 extending into an annular groove 93 formed in the tube 80. The portion 92 is formed by flexible fingers which may be slipped over the forward end of the part 37. After the parts are connected, an axially movable locking ring 94 is moved rearwardly to a position over the forward end of the part 37, thereby preventing the parts from becoming accidentally disconnected. However, when it is desired to decouple the aeration attachment 75 from the nozzle 20, the locking ring 94 may be manually moved forwardly as shown in FIG. 11. This enables the rearward end portion 92 to be flexed outwardly and allows the attachment 75 to be removed from the nozzle 20. Axial movement of locking ring 94 may be affected by the use of linkages, cam, threads or the like.

In the position of the parts illustrated in FIG. 4, the peripheral jet nozzle 20 is turned off because the shaper 21 is moved toward the right relative to the plunger 23 until an annular radially inwardly extending ridge 96 on the shaper 21 engages the upstream face of the baffle 33, thereby closing the flow passage 32 through the nozzle.

In the position of the parts illustrated in FIG. 5, the shaper is moved slightly toward the left relative to the plunger, thereby moving the ridge 96 away from the baffle 33. This enables the water to flow through the flow passage 32 of the nozzle 20, but since the outer periphery of the baffle 33 is still radially confined within the forward end of the bore of the shaper, the water leaving the peripheral jet nozzle 20 is in a substantially constant diameter tubular stream 101. The water flowing past the ridge 96 is directed forwardly by an annular, axially extending surface of the shaper. The stream 101 strikes the screen 81 which creates turbulence and partially aerates the water, producing a wetter foam as indicated by the numeral 102, which will have a good reach or distance because the spray is confined to a rather tight, small diameter stream. Air for the foam enters through the openings 84.

Figure 6:
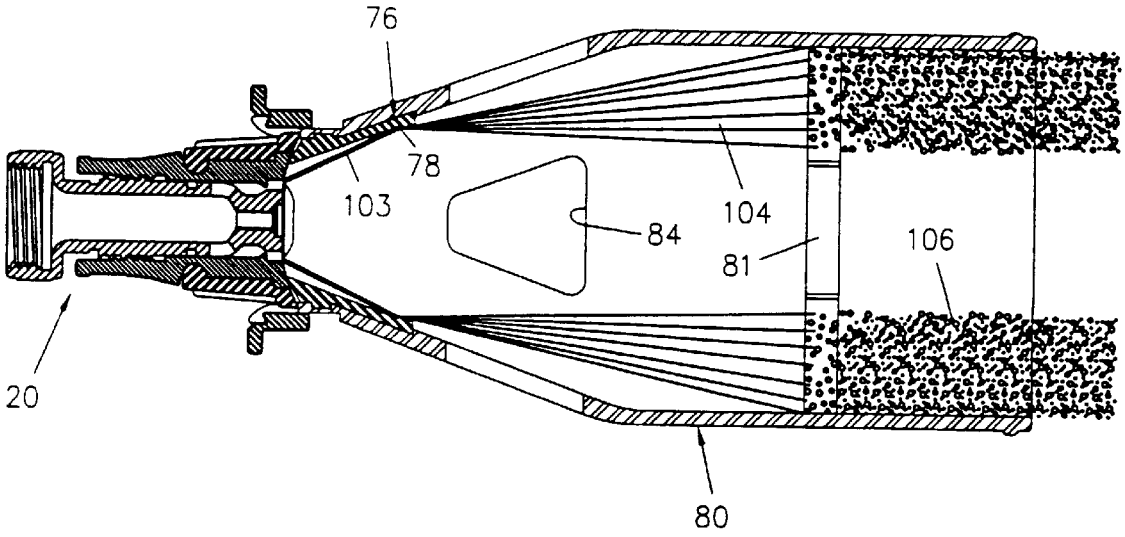

In the position of the parts illustrated in FIG. 6, the shaper is moved farther to the left relative to the plunger to the point where the baffle 33 emerges from the bore of the shaper 21. The water leaving the nozzle 20 exits at a taper or angle to form a conical stream 103. In the position illustrated, this stream 103 strikes the obstruction 78 and the obstruction 78 causes the stream 103 to form a spray 104. The interior portion of the spray extends substantially axially to the screen 81 while the exterior portion angles radially outwardly to the outer periphery of the screen 81. Thus, the spray is concentrated at the annular outer portion of the screen 81 and produces the pattern of foam 106, which has a lesser reach, or distance, but greater aeration than that of FIG. 5.

Figure 7:
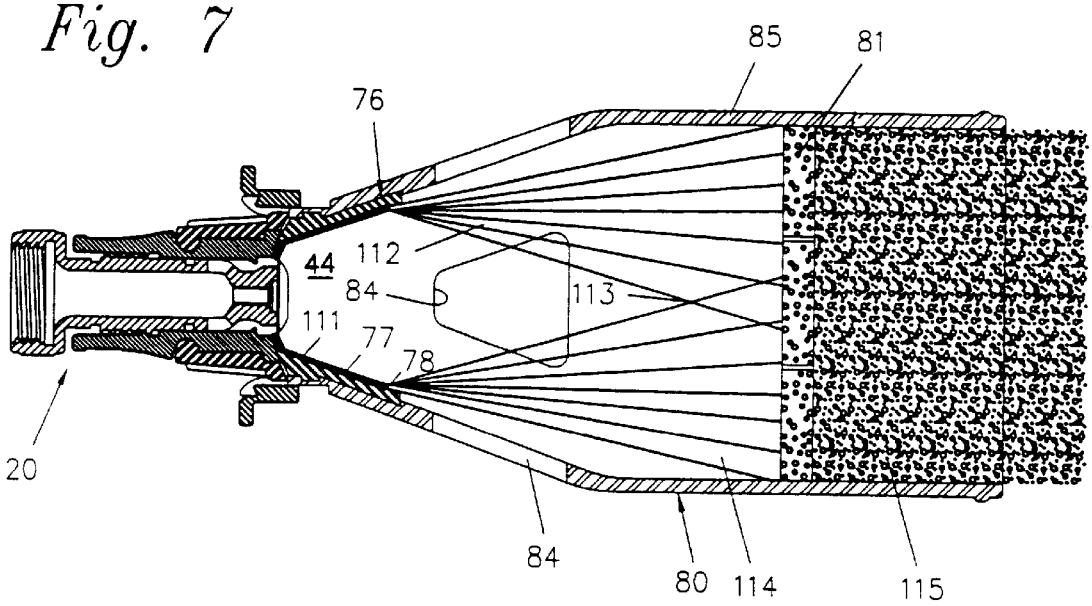

With regard to FIG. 7, the shaper is moved farther back and the conical sheet or stream 111 of water leaving the flow passage 32 around the baffle 33 engages the tapered inner wall surface 77 of the collector 76 and flows along this wall surface 77 to the obstruction 78. At this point the water is deflected and the interior portion 112 of the stream 111 angles forwardly and radially inwardly toward the axis of the nozzle as previously described. At approximately the point 113 the spray closes the hollow interior 44. The outer portion 114 of the spray angles radially outwardly and strikes the interior surface of the aeration section 85 immediately rearwardly of the screen 81. Thus, the spray is distributed relatively uniformly across the screen 81, producing a foam 115 with the lowest reach or distance but the highest aeration. A portion of the aeration section 85 extends forwardly of the screen 81 and confines the foam 115 to a filled cylindrical pattern. It will be noted that the air intake openings 84 are rearwardly of the point where the stream 114 strikes the aeration section 85. There exists a continuous range of foam aeration and distance combinations at intermediate spray angles between the positions of FIGS. 5, 6 and 7.

Figure 8:
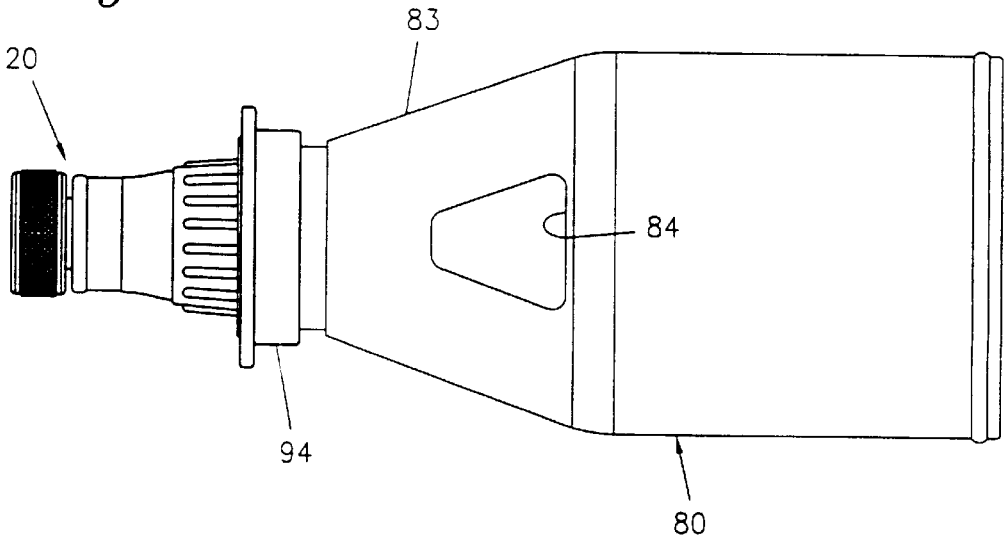
FIG. 8 is a side view of the nozzle of FIG. 4.
Figure 9:
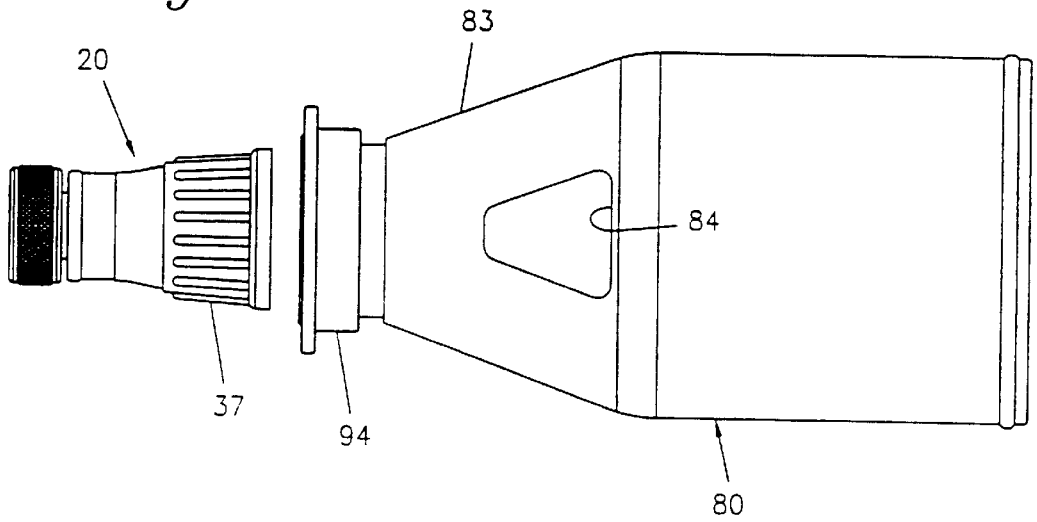
FIG. 9 shows the nozzle of FIG. 4 in partially disassembled relation.

FIG. 8 shows the parts fully assembled, and FIG. 9 shows the aeration attachment 75 disconnected from the peripheral jet nozzle 20 so that the nozzle 20 may be used in the conventional manner. The aeration attachment is removed as previously explained by shifting the locking ring 94 toward the right and pulling the nozzle sufficiently to flex the collet fingers outwardly. Quick removal of an attachment is desirable should the fireman instantly require wide spray patterns from the nozzle.

Figure 10:
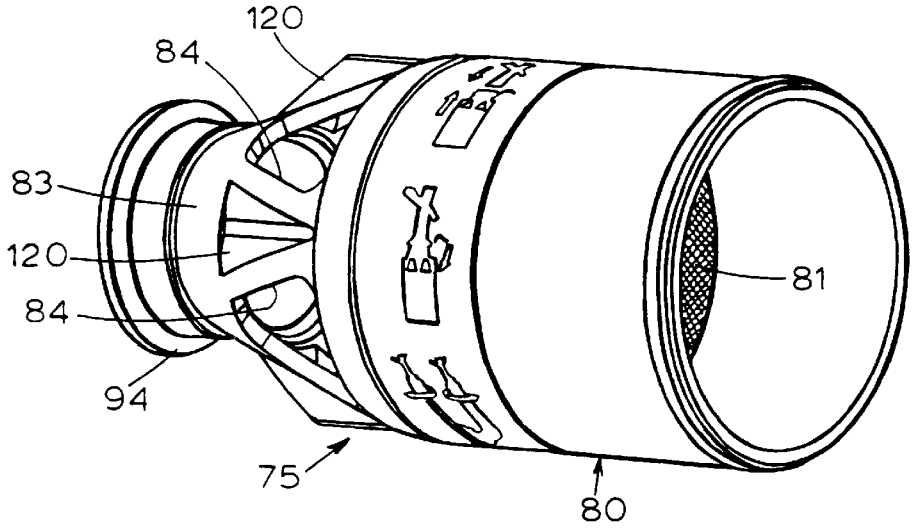
FIG. 10 is a perspective view of a portion of the nozzle of FIG. 4.

FIG. 10 illustrates the openings 84 formed in the aeration attachment 75 which enables air to enter the rearward end of the attachment and mix with the water-foaming agent. The conical part 83 may be provided with triangular raised portions 120 between the openings 84, to strengthen the part, which may be made of a molded plastic.

Figure 12:
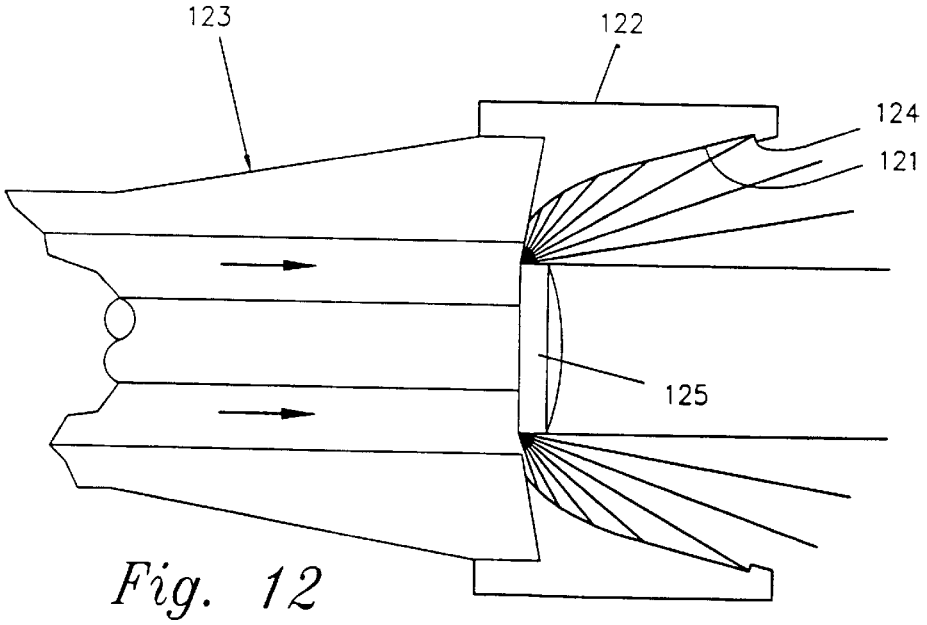
FIG. 12 is a schematic diagram illustrating an alternative embodiment of the invention.

In the embodiments of the invention described above, the internal wall surface of the collector has a relatively straight angle of taper. In the embodiment illustrated in FIG. 12, however, the internal wall surface 121 of the collector 122 is curved or contoured to a somewhat elliptical shape. The collector 122 is fastened to the forward end of a peripheral jet nozzle 123 as previously described, and the internal wall surface 121 is curved from the forward end of the nozzle flow passage to the obstruction 124. The design shown in FIG. 12 may be useful where the water stream leaving the flow passage around the baffle 125 has a varying angle forwardly and radially from the nozzle 123. By this construction, the nozzle exit spray always contacts the wall 121 of the collector 122 at a relatively shallow angle, causing the water stream to flow along the wall surface 121 to the obstruction 124. An aeration tube with a radial screen as shown, for example, in FIG. 3 or FIG. 4 would be attached to the collector 122 but is not shown in FIG. 12.

Figure 13:
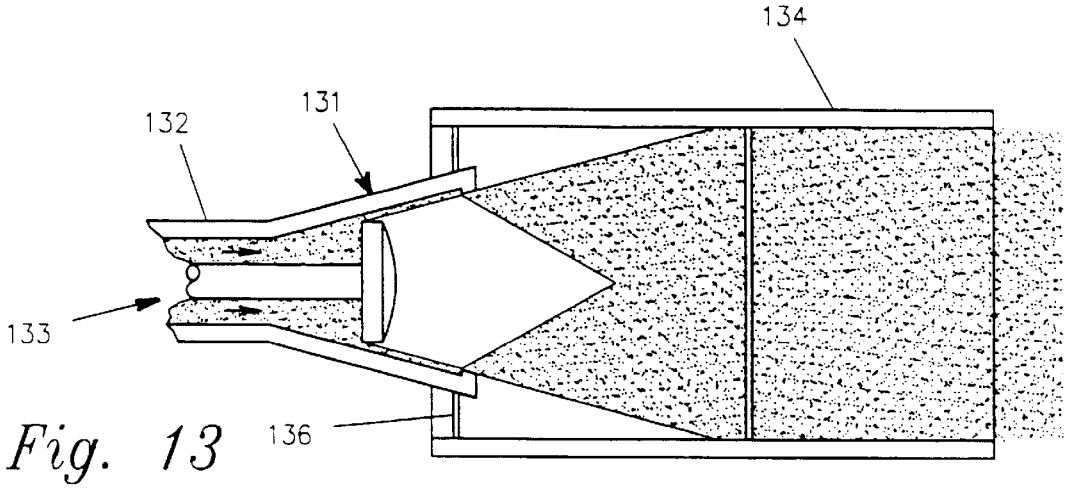
FIG. 13 is a schematic diagram showing another alternative embodiment of the invention.

FIG. 13 illustrates an embodiment of the invention which is generally similar to that shown in FIG. 3 with the exception that the collector 131 is integrally formed with a forward end of the shaper 132 of the peripheral jet nozzle 133. An aeration tube 134 is mounted on the forward end of the collector 131 by suitable means such as struts 136.

With reference to FIG. 11, the size of the lip or obstruction 78 directly influences the type of spray produced. Enlarging the distance the lip 78 inwardly projects will cause increasingly more spray to be directed towards the central axis 28 of the nozzle. The entire spray could be directed inwards upon itself if the size of the lip were great enough. Reducing the height of the distance the lip 78 inwardly extends permits increasingly greater portions of the spray to continue in a direction substantially parallel to the inside surface 77 of the spray collector.

The lip 78 of the preferred embodiment is perpendicular to the inside surface 77 of the spray collector 76. Angles of greater and less than perpendicular have been tried, but their effect on the type of spray produced is substantially minor compared to the effect produced by small changes in lip height.

A corner radius 141 joining the inside surface 77 with the upstream face of the inwardly projecting lip 78 has little influence on the spray, and may be sized to eliminate sharp corner stress concentrations. However, the corner radius of the portion 142 of the lip 78 most inwardly extending can be sized to optimize the spray distribution exiting from the spray collector. A radius of about 0.005 inch gives the best results with the common sizes of hand held nozzles.

The dimension 143 of the lip for the preferred embodiment is substantially equal to the thickness of the water sheet exiting the nozzle.

When the nozzle operates as shown in FIG. 7, the angle of the outer portion 114 of the spray exiting from the collector 76 of the preferred embodiment tends to be at an angle with respect to the central axis 28 of about five degrees per side less than the angle of the inside surface 77 of the spray collector 76.

The diameter of the foam aeration section 85 is selected to give the desired type of foam. Generally, the larger the tube, the greater the expansion ratio. Every type of foam chemical mixture has limitations, so for a given flow and pressure, and foam type there exists some diameter beyond which it becomes impractical to produce a good quality foam. In addition, space limitations desirable to a firefighter dictate a compromise to a reasonable size device that still yields acceptable foam expansion.

For the types of low and medium expansion foams in common use in fire fighting class A (flammable solids) and class B type fires (flammable liquids), it has been found that a diameter of the aeration section 85 having a flow area approximately 100 times the exit area of the nozzle 20 is the optimum compromise.

Although the aeration section 85 is depicted in the drawings with an inside surface that is substantially parallel to the central axis 28, it is believed that other shapes such as diverging, or divergent/convergent may be successfully used in the aeration of foams, such as those depicted in the prior art in U.S. Pat. No. 2,774,583, No. 3,424,250, and No. 3,547,200. Aeration methods such as those shown in these patents may also be adapted to produce foam when used in combination with a spray collector and a peripheral jet nozzle as described herein.

The length of the foam aeration section 85 depends on the method of creating the foam. Some methods of creating foam rely on tossing and tumbling of the foam down a relatively long enclosure such as that depicted in U.S. Pat. No. 4,830,790, No. 3,946,947, and No. 3,918,647. In this case, relatively long lengths are required, on the order of 10 to 20 times the diameter.

Other methods of aerating foam rely on some form of agitation by means of passing the liquid-air mixture across some stationary object such as a screen, or a series of projections, as depicted in U.S. Pat. No. 4,219,159, No. 3,836,076, No. 4,330,086, and No. 4,830,790. The length of the foam aeration section 85 required for these methods is relatively short.

The size of the air intake openings 84 also influences foam quality. The smaller the opening area becomes, the greater is the loss of kinetic energy to the jet, while also reducing the amount of air that can be incorporated into the foam. The area of the openings 84 in the preferred embodiment is approximately equal to the area of the aeration section 85 near the screen 81.

With reference again to FIG. 11, the front face of the nozzle 20 contacts the inside diameter of the spray collector 76. The spray collector 76 of the preferred embodiment is made from an elastomeric material such as 70 durometer Shore A nitrile rubber. The liquid exiting the nozzle 20 set on maximum spray is in substantial contact with the face of the nozzle, until such time as it impacts on the inside 77 of the spray collector 76. The water acts on the blunt corner 146 of the spray collector 76 to push it into contact with the front face 147 of the nozzle 20 to achieve a substantially liquid tight seal. In this way even when the nozzle is set on maximum angle, there is no undesirable discharge exiting between the nozzle and the foam aspiration device.

Since the particular flow path of the nozzle 20 leading up the peripheral discharge around the disk 33 is not part of this invention, the nozzle 20 having the simplest flow path is depicted. It should be understood, however, that the aeration device and spray collector could be combined with other types of peripheral jet nozzles, whether of fixed orifice, adjustable orifice, or pressure controlling orifice designs. The present nozzle depicted in FIG. 1 is a simple nozzle and is generally described in U.S. Pat. No. 2,936,960. This type of nozzle sometimes has no projections on its exit face.

The projections on the discharge end face of the nozzle are used to produce spray patterns having more thickness than the sheet of spray produced by a nozzle without projections. These projections area commonly referred to as fog teeth. The utility of the thicker spray is especially appreciated by firefighters using nozzles without foam aeration attachments in close quarters with flames.

Aeration devices with spray collectors can be designed to work in conjunction with nozzles having fog teeth and exit faces of various types such as those depicted in U.S. Pat. Nos. 3,244,376, 4,176,794, and No. 4,289,277. In this case the inwardly projecting lip 78 or obstruction should be shaped and sized in conjunction with the spray produced by the fog teeth accordingly to produce a relatively uniform conical spray entering the foam aeration section.

Nozzles having no fog teeth such as those depicted in U.S. Pat. No. 3,539,112 or No. 4,497,442 would need a spray collector having an inwardly projecting lip 78 of somewhat greater proportions.

For nozzles of substantially peripheral jet design, but equipped with various secondary jets such as the one generally depicted in U.S. Pat. No. 2,928,611, the size and shape of the inwardly projecting lip 78 would be made to work in conjunction with the spray exiting from the secondary orifices to produce a substantially similar spray type entering the foam aeration section.

When the present invention is fitted onto a nozzle of substantially the same type described in U.S. Pat. No. 4,653,693, the nozzle produces a conical spray that is already of a substantially uniform distribution. The spray need only be contained to the desired angle within the spray collector to achieve the desired spray on the foam aeration section, thus in this case no lip is needed.

Nozzles of the type generally described in U.S. Pat. No. 4,095,749, No. 4,252,278, No. 4,653,693, and No. 5,125,579 have a plurality of projections covering substantially the entire exit face of the nozzle. The foam aeration section can be equipped with a seal on the inside diameter of the foam aeration section where it engages the front portion of the nozzle, the seal contacting the outermost diameter of the nozzle, and producing a substantially liquid tight seal when the nozzle is in wide angle spray settings. The spray collector and inwardly projecting lip (if any) could be made from rigid materials since no sealing lip on the collector is present.

It can be appreciated from the above discussion that the combination of the foam device onto virtually any type of peripheral jet nozzle is possible, and quite useful.

What is claimed is:

1. A foam-producing nozzle assembly comprising:

a jet nozzle comprising a shaper and a plunger, the jet nozzle being capable of emitting a conical sheet of fluid from an aperture between the shaper and the plunger;

a screen extending transversely across an aeration tube;

a collector extending between the shaper and the screen and having an obstruction positioned laterally between the shaper and the screen; and means for selectively configuring the nozzle assembly to produce either a first spray pattern, in which a conical sheet of fluid flows directly from the jet nozzle to the screen without engaging the obstruction on the collector, and a second spray pattern, in which a conical sheet of fluid engages the collector and is at least partially redirected toward a central axis of the nozzle before striking the screen.

2. A foam producing nozzle as set forth in claim 1, wherein said peripheral jet nozzle is adjustable to vary said conical sheet of liquid to various acute half angles.

3. A foam producing nozzle as set forth in claim 1, wherein said obstruction comprises an annular lip which is substantially perpendicular to a conical interior surface of the collector.

4. A foam producing nozzle as set forth in claim 1, wherein said obstruction has a height which is substantially equal to the thickness of said sheet of liquid.

5. A foam producing nozzle as set forth in claim 1, wherein said aeration tube further includes means for supplying air to said flow between said collector and said screen.

6. A foam producing nozzle as set forth in claim 1, and further including means for detachably connecting said aeration tube to said peripheral jet nozzle.

7. A foam producing nozzle as set forth in claim 1, wherein said collector is formed integrally with said peripheral jet nozzle.

8. A foam producing nozzle as set forth in claim 1, wherein said obstruction is sized to deflect a portion of said liquid forwardly and radially inwardly toward a point on said central axis, another portion of said liquid flowing forwardly and radially outwardly toward an annular portion of said tube, said screen being located forwardly of said point and said annular portion.

9. A foam producing nozzle as set forth in claim 8, wherein said annular portion is close to said screen.

10. An aeration attachment for use with a peripheral jet nozzle that includes a shaper and a plunger, the jet nozzle being capable of emitting a conical sheet of fluid from an aperture between the shaper and the plunger, the attachment comprising:

a screen extending transversely across an aeration tube;

a collector configured to attach to and extend between the shaper and the screen and having an obstruction positioned laterally between the shaper and the screen such that fluid emitted from the jet nozzle in a first spray pattern will flow directly to the screen without engaging the obstruction on the collector, but a fluid emitted from the jet nozzle in a second spray pattern will engage the collector and be at least partially redirected toward a central axis of the nozzle before striking the screen.

11. An aeration attachment as set forth in claim 10, wherein said obstruction is sized to deflect a portion of fluid in the second flow pattern forwardly and radially inwardly toward a point on said central axis, another portion of fluid in the second flow pattern flowing forwardly and radially outwardly toward an annular portion of said tube, said screen being located forwardly of said point and said annular portion.

12. An aeration attachment as set forth in claim 10, wherein said obstruction comprises an annular lip which is substantially perpendicular to a conical interior surface of the collector.

13. An aeration attachment as set forth in claim 10, wherein said obstruction has a height which is substantially equal to the thickness of the fluid in the second spray pattern.

14. An aeration attachment as set forth in claim 10, and further including means for supplying air to fluid in the second spray pattern between said collector and said screen.

15. An aeration attachment as set forth in claim 10, further comprising means for detaching the collector from the shaper.

16. An aeration attachment as set forth in claim 11, wherein said annular portion is close to said screen.

* * * * *

UNITED STATES PATENT AND TRADEMARK OFFICE

CERTIFICATE OF CORRECTION

PATENT NO. : 5,848,752

DATED : December 15, 1998

INVENTOR(S) : Kolacz, et al

It is certified that error appears in the above-identified patent and that said Letters Patent is hereby corrected as shown below:

On the title page, [63] Related U.S. Application Data), it is not stated that patent serial no. 525,913 is "abandoned".

On the title page, item [56], column 2, line 3, document no. 386,746 is from "Austria" not "Australia".

column 2, line 18, title of "Brochure of Group Leader S.A." should be in all capital letters.

column 2, line 21, article title by "Jean-Francios Becker" should be in all capital letters and "Bechker" should be "Becker".

Page 2, column 1, line 7, under patent no. 4,252,278, "McMillin" should be "McMillan".

UNITED STATES PATENT AND TRADEMARK OFFICE

CERTIFICATE OF CORRECTION

PATENT NO. : 5,848,752

DATED : December 15, 1998

INVENTOR(S) : Kolacz, et al

It is certified that error appears in the above-identified patent and that said Letters Patent is hereby corrected as shown below:

Page 2, column 2, line 15, article title "Appareillage . . ." should be in all capital letters.

Page 2, column 2, line 19, "catalot" should be "catalog".

Signed and Sealed this

Twenty-eighth Day of November, 2000

*Attest:*

*Attesting Officer*

Q. TODD DICKINSON

*Director of Patents and Trademarks*